US010451338B2

(12) United States Patent
Cordero et al.

(10) Patent No.: US 10,451,338 B2
(45) Date of Patent: Oct. 22, 2019

(54) DOOR STORAGE BIN ASSEMBLY FOR A REFRIGERATOR

(71) Applicant: Electrolux Home Products, Inc., Charlotte, NC (US)

(72) Inventors: Carlos Cordero, Anderson, SC (US); Dennis Schenk, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 15/835,746

(22) Filed: Dec. 8, 2017

(65) Prior Publication Data

US 2019/0178566 A1 Jun. 13, 2019

(51) Int. Cl.

| | |
|---|---|
| ***F25D 25/02*** | (2006.01) |
| ***F25D 11/02*** | (2006.01) |
| ***F25D 23/02*** | (2006.01) |
| ***F25D 23/04*** | (2006.01) |

(52) U.S. Cl.

CPC ..... *F25D 25/02* (2013.01); *F25D 11/02* (2013.01); *F25D 23/028* (2013.01); *F25D 23/04* (2013.01); *F25D 2325/021* (2013.01)

(58) Field of Classification Search

CPC ..... F25D 23/04; F25D 23/028; F25D 23/067; F25D 25/02; F25D 25/022; F25D 2325/021

See application file for complete search history.

(56) References Cited

U.S. PATENT DOCUMENTS

| | | | |
|---|---|---|---|
| 3,409,260 A | 11/1968 | Bleed | |
| 3,464,212 A | 9/1969 | Yamagata | |
| 3,647,075 A | 3/1972 | Aue | |
| 3,698,565 A | 10/1972 | Weber | |
| 3,886,698 A | 6/1975 | Raith | |
| 4,008,872 A | 2/1977 | Thompson | |
| 4,174,486 A | 11/1979 | Winkler | |

(Continued)

FOREIGN PATENT DOCUMENTS

| | | | |
|---|---|---|---|
| DE | 29502535 | 6/1996 | |
| DE | 19633975 A1 * | 2/1998 | ..... A47B 57/20 |

(Continued)

OTHER PUBLICATIONS

DE102009045058A1 Translated Description, 11 pages (Year: 2011).*

(Continued)

*Primary Examiner* — Andrew M Roersma

(74) *Attorney, Agent, or Firm* — Pearne & Gordon LLP

(57) ABSTRACT

A storage system and a refrigeration appliance including the storage system for storing food items in a temperature-controlled environment are provided. The storage system includes at least one rail with at least one elongated main portion extending along the width of the refrigerator door and two support arms on each side of the elongated main portion, and a plurality of detachable storage bins. The two support arms attach the rail to at least one mounting structure of a plurality of mounting structures formed within the liner panel and spaced vertically along the height of the interior of the refrigerator door. The storage bin has an arm extending from a rear surface of the bin and configured to be placed between the rail and the liner panel when the bin is placed in a storage position.

14 Claims, 9 Drawing Sheets

(56) References Cited

U.S. PATENT DOCUMENTS

| | | | | |
|---|---|---|---|---|
| 4,615,448 | A | 10/1986 | Johnstonbaugh | |
| 4,779,939 | A | 10/1988 | Stich | |
| 4,826,022 | A | 5/1989 | Duarte | |
| 4,908,544 | A | 3/1990 | Lau | |
| 5,018,323 | A | 5/1991 | Clausen | |
| 5,138,803 | A | 8/1992 | Grossen | |
| 5,322,366 | A | 6/1994 | Revlett et al. | |
| 5,549,379 | A | 8/1996 | Jun | |
| 5,638,962 | A | 6/1997 | Price | |
| 5,791,093 | A | 8/1998 | Diamond | |
| 6,085,542 | A | 7/2000 | Johnson | |
| 6,582,038 | B2 | 6/2003 | Moreno-Olguin et al. | |
| 6,908,163 | B1 | 6/2005 | Hebeler et al. | |
| 7,300,120 | B2 | 11/2007 | Shin | |
| D589,728 | S | 4/2009 | Shaha et al. | |
| 7,748,805 | B2 | 7/2010 | Lucas et al. | |
| 7,766,437 | B2 | 8/2010 | Lim et al. | |
| 7,992,728 | B2 | 8/2011 | Burgess | |
| 8,439,462 | B2 | 5/2013 | Seo et al. | |
| 9,389,012 | B2 | 7/2016 | Rackley et al. | |
| 9,435,579 | B1 * | 9/2016 | House | F25D 23/028 |
| 9,657,984 | B2 | 5/2017 | Wang et al. | |
| 9,803,913 | B2 | 10/2017 | Burke et al. | |
| 2004/0149669 | A1 | 8/2004 | Tomonari et al. | |
| 2007/0159041 | A1 | 7/2007 | Lucas et al. | |
| 2008/0231159 | A1 | 9/2008 | Lee et al. | |
| 2013/0081421 | A1 | 4/2013 | Kwon et al. | |
| 2015/0168048 | A1 | 6/2015 | Sexton et al. | |
| 2015/0292792 | A1 * | 10/2015 | Shrader | F25D 23/02 312/405.1 |
| 2017/0108265 | A1 | 4/2017 | Wang et al. | |
| 2017/0328627 | A1 | 11/2017 | Park et al. | |
| 2018/0224192 | A1 * | 8/2018 | Baker | F25D 23/04 |

FOREIGN PATENT DOCUMENTS

| | | | | |
|---|---|---|---|---|
| DE | 20 2010 006876 | | 5/2010 | |
| DE | 102009045058 | | 3/2011 | |
| EP | 0707184 | | 4/1996 | |
| EP | 0918200 | A2 * | 5/1999 | A47B 57/32 |
| EP | 2405218 | | 1/2012 | |
| FR | 2307238 | A1 * | 11/1976 | F25D 23/04 |
| GB | 2203028 | | 10/1988 | |
| KR | 20020068929 | | 8/2002 | |
| KR | 102007010609 | A * | 11/2007 | F25D 23/04 |
| NL | 6706574 | | 11/1967 | |
| WO | 9321487 | | 10/1993 | |
| WO | 98/08036 | | 2/1998 | |
| WO | 98/08037 | | 2/1998 | |
| WO | 2007/033951 | | 3/2007 | |
| WO | 2008/080919 | | 7/2008 | |
| WO | 2010/112296 | | 10/2010 | |
| WO | 2011/057961 | | 5/2011 | |
| WO | 2015/107118 | | 7/2015 | |
| WO | 2016134987 | | 9/2016 | |
| WO | WO-2016134987 | A1 * | 9/2016 | F25D 23/04 |

OTHER PUBLICATIONS

EP2405218A2 Translated Description, 7 pages (Year: 2012).*
International Search Report and Written Opinion issued in Application No. PCT/US2014/039310 dated Oct. 13, 2014.
International Search Report for PCT/US2018/064394, dated Mar. 7, 2019, 2 pages.

* cited by examiner

DOOR STORAGE BIN ASSEMBLY FOR A REFRIGERATOR

FIELD OF INVENTION

The following description relates generally to a refrigeration appliance, and more specifically to a door storage bin assembly conversion kit that allows the user to upgrade a refrigerator unit from a fixed door bin system to a new modular and customizable Flex-store door storage bin assembly system.

BACKGROUND OF INVENTION

Refrigeration appliances, such as domestic refrigerators, have one or more doors providing access to items stored within the fresh food and the freezer compartments. Refrigerator doors typically include shelves or bins mounted to the interior of the door. Storage bins may be used for specific purposes, such as storing dairy products in various small containers or accommodating milk or juice jugs in large trays or containers.

Removable storage bins have become popular, as they allow the consumer to maximize the use of available storage space in the refrigeration compartments by positioning storage bins in different arrangements that best accommodate storing a variety of stored items, clean the bins, and provide an unobstructed view of and easy access to the items. Mounting supports, such as frames, ribs, or other retaining structures may be formed in the refrigerator door liner for attaching rails capable of supporting removable storage bins by way of clips, hooks, or similar attaching elements.

The known removable bin configurations do not always allow complete utilization of the available storage space in the refrigerator doors. For example, one side of a rail may accommodate a large bin while the other side of the rail may remain unused because there is insufficient rail space or a solid support structure to securely retain additional bins on the unused side of the rail. In addition, consumers often store in the refrigerator items with different sizes and shapes depending on changing weather, availability of seasonal food items, varying diet requirements, or other personal preferences. The various items may require different bins. However, existing storage bins systems often do not accommodate these changing storage requirements. Therefore, it is desirable to provide a flexible removable storage bin system that would allow consumers to completely utilize the available storage space on the refrigerator doors when the consumers' storage needs change.

SUMMARY

The present invention provides a flexible storage conversion kit that allows the user to upgrade any refrigerator unit from a fixed door bin system to a new storage system depending on the user's requirements.

A refrigerator door storage bin assembly system comprises a refrigerator door comprising a liner panel and a storage space with an opposed pair of side walls. A plurality of mounting structures are formed within the liner panel to extend outwardly from each of the pair of side walls, and corresponding horizontally aligned pairs of the mounting structures spaced vertically along a height of an interior of the refrigerator door. A plurality of rails are provided, each rail including at least one elongated main portion extending in a generally horizontal direction along a width of the door and two support arms on each side of the at least one elongated main portion, each of said two support arms being configured to attach to at least one of the corresponding horizontally aligned pairs of said plurality of mounting structures. A plurality of detachable storage bins are provided, each storage bin comprising a container and at least one fastener located in a rear top portion of the storage bin. Said at least one fastener is configured to attach the storage bin to the at least one elongated main portion of at least one rail and allow at least one storage bin to slide laterally in a plurality of positions along a width of the at least one rail.

A refrigeration appliance comprises at least one compartment for storing items in a refrigerated environment and a refrigeration system for providing a cooling effect within the compartment. At least one door is attached to the refrigeration appliance and provides access to the at least one compartment, wherein the door comprises a liner panel with an opposed pair of side walls and a door storage bin assembly system. The door storage bin assembly system comprises a plurality of mounting structures formed within the liner panel to extend outwardly from each of the pair of side walls and corresponding horizontally aligned pairs of the mounting structures spaced vertically along a height of an interior of the refrigerator door. A plurality of rails is provided, each rail including at least one elongated main portion extending in a generally horizontal direction along a width of the door and two support arms on each side of the at least one elongated main portion, each of said two support arms being configured to attach to at least one of the corresponding horizontally aligned pairs of said plurality of mounting structures. A plurality of detachable storage bins is provided, each storage bin comprising a container, and at least one fastener located in a rear top portion of the storage bin. Said at least one fastener is configured to attach the storage bin to the at least one elongated main portion of at least one rail and allow at least one storage bin to slide laterally in a plurality of positions along a width of the at least one rail.

Other features and aspects may be apparent from the following detailed description, the drawings, and the claims.

BRIEF DESCRIPTION OF THE DRAWINGS

The foregoing and other aspects of the present disclosure will become apparent to those skilled in the art to which the present disclosure relates upon reading the following description with reference to the accompanying drawings, in which.

Figure 1:
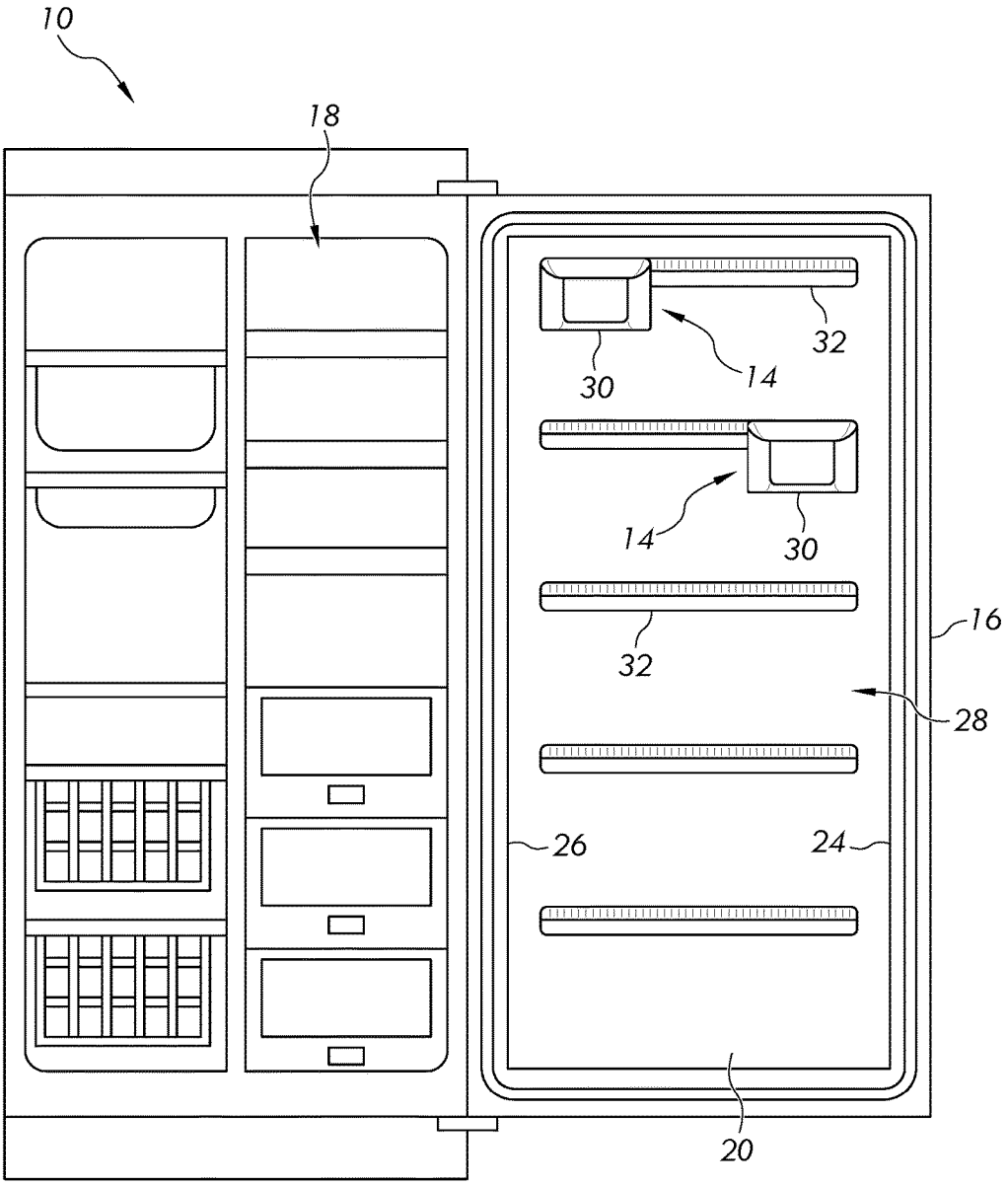
FIG. 1 illustrates a schematic front view of a refrigerator including an example storage bin system in accordance with aspects of the present disclosure.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Example embodiments that incorporate one or more aspects of the apparatus and methodology are described and illustrated in the drawings. These illustrated examples are not intended to be a limitation on the present disclosure. For example, one or more aspects of the disclosed embodiments can be utilized in other embodiments and even other types of devices. Moreover, certain terminology is used herein for convenience only and is not to be taken as a limitation.

FIG. 1 depicts a schematic view of a refrigeration appliance, such as refrigerator 10, including a schematic depiction of an example storage system 14 in accordance with aspects of the present invention. It is to be appreciated that the view of FIG. 1 omits some detail of the storage system 14 for simplicity. The refrigerator 10 can include a door 16 which provides access to a compartment 18 which can include a refrigerator compartment, a freezer compartment, or any other type of compartment. For example, the compartment 18 can be configured for storing food items in a temperature-controlled environment having a target temperature.

Figure 2:
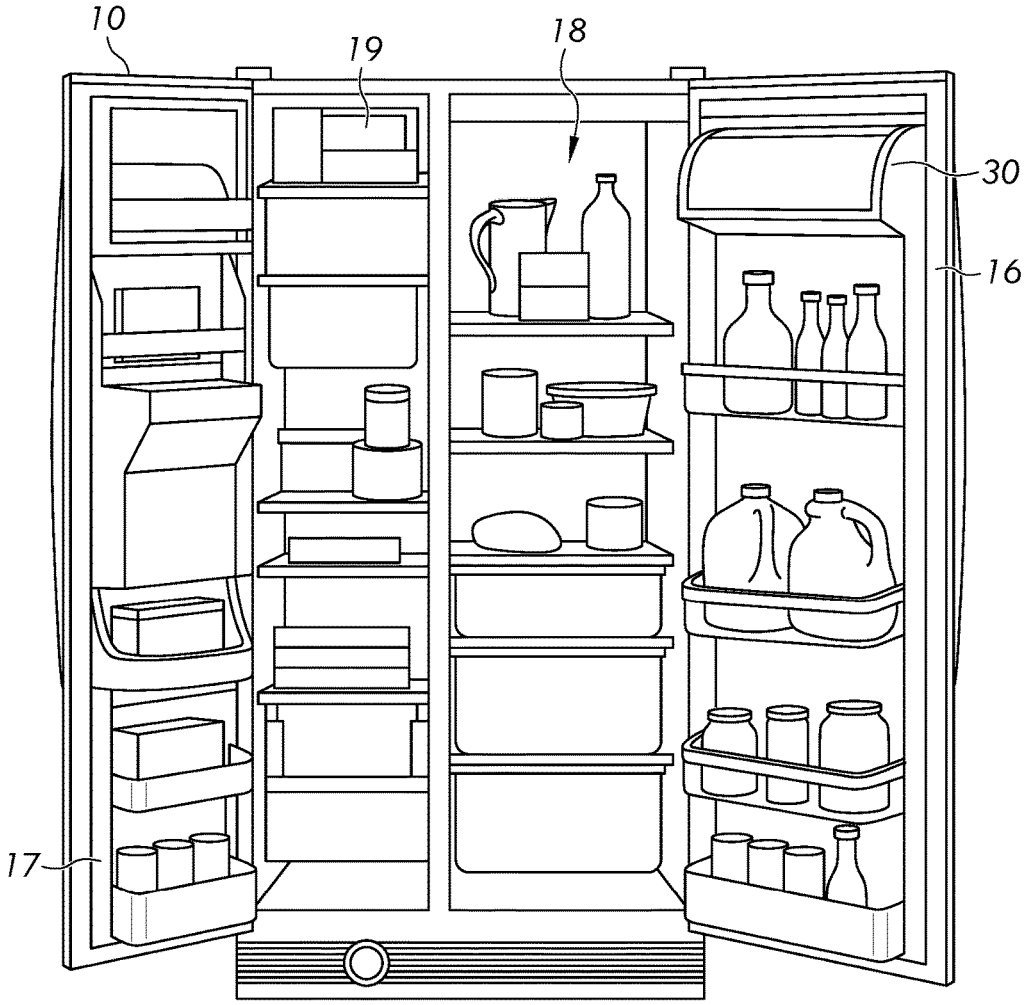
FIG. 2 is a schematic view of an example refrigerator in accordance with aspects of the present disclosure.

FIG. 1 illustrates only one compartment 18 of the refrigerator 10. However, as shown in FIG. 2, the refrigerator 10 can further include a side by side fresh food compartment 18 and a freezer compartment 19, for example. In further examples, the refrigerator 10 can be a so-called French door bottom mount freezer assembly. A French door bottom mount freezer assembly can include a fresh food compartment 18 provided at an upper portion of the refrigerator 10 while the freezer compartment 19 is provided at a bottom portion and underneath the fresh food compartment 18. Of course, in some cases, the freezer compartment 19 may be located above the fresh food compartment 18 (i.e., a top mount refrigerator). In a further example, the refrigerator 10 could include either of the fresh food compartment 18 or the freezer compartment 19 positioned laterally on top of the other of the fresh food compartment 18 or freezer compartment 19. In further examples, the refrigerator 10 could be provided with multiple compartments or with compartments located above and/or laterally with respect to one another. In yet another example, the refrigerator 10 may include only a freezer compartment 19 provided without a fresh food compartment 18, or vice-versa.

Whatever arrangement of the freezer compartment 19 and the fresh food compartment 18 may be employed, typically, separate access doors are provided for the refrigerated compartments so that either compartment may be accessed without exposing the other compartment to the ambient air. For example, a door 17 provides access to the freezer compartment 19, and a separate door 16 provides access to the fresh food compartment 18 of the refrigerator 10. Although the embodiments described in detail below, and shown in the figures are a side by side configuration of a refrigerator with a fresh food compartment and a freezer compartment, the refrigerator can have any desired configuration including at least one compartment for storing food items, at least one door for closing the compartment(s), and a flexible storage bin system, without departing from the scope of the present invention. Accordingly, it is to be appreciated that the refrigerator 10 shown in FIG. 1 comprises only one possible example, as any number of designs and configurations are contemplated.

Turning back to the shown example of FIG. 1, the refrigerator 1 includes a fresh food compartment 18. The fresh food compartment 18 defines a substantially hollow interior portion and may include shelves, drawers, or the like. The door 16 can include a plurality of interior walls, such as a rear wall 20, a right side wall 24, and a left side wall 26. In one example, the rear wall 20, the right wall 24, and the left wall 26 can all be portions of one unitary door liner component such as liner panel 28. While not shown, the refrigerator 10 can include a refrigeration system for providing a cooling effect to the compartment 18. It is to be appreciated that the fresh food compartment 18 shown in FIG. 1 is somewhat generically depicted, as the fresh food compartment 18 can include any number of shelves, drawers, bins, etc.

The storage system 14 can be configured to be mounted to the door 16 of the refrigerator 10. The storage system 14 is configured to enable selective horizontal sliding of at least one bin 30 along a plurality of locations on at least one rail 32 mounted on the interior of the door 16. FIG. 1 shows a number of storage systems 14 at various elevations of the door 16. The storage system includes multiple rails 32 and bins 30.

Figure 3:
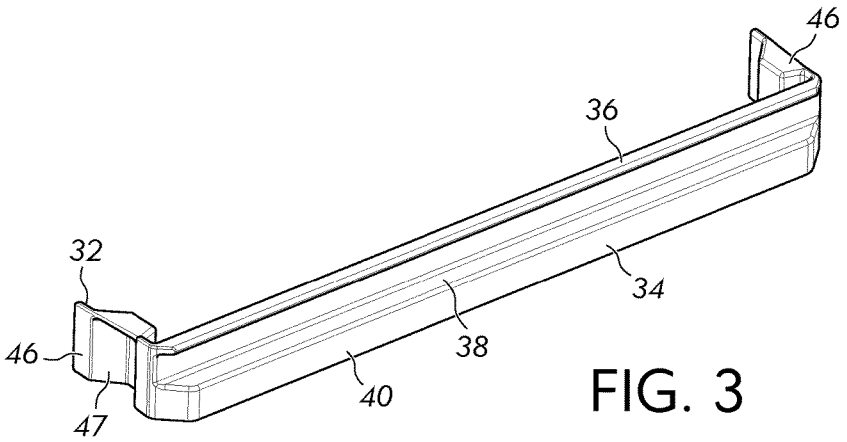
FIG. 3 is a perspective view of an example rail, which is part of the storage bin system, according to an embodiment.

FIG. 3 shows a perspective view of the rail 32 in one example of the subject invention. Conventional rails were rigidly fixed to the interior of the refrigerator door and were not removable or adjustable. However, in the instant application as described herein, the new rails are customizable and adjustable vertically along the refrigerator door interior. In this example, the rail 32 is a "U"-shaped rail that includes an elongated straight substantially horizontal main rail 34 for supporting various hanging baskets, containers, etc. The number, type, and arrangement of the hanging items can be customized by the user. The rail 32 further includes a top surface 36, a substantially vertical portion 38, which may include one or more, such as two, stepped vertical segments (as illustrated in FIG. 3), and a rear-facing surface 40. The rail 32 also includes two short support arms 46 located on opposite ends of the main rail 34. Each support arm 46 includes on its exterior surface a female molded recess 47. The main rail 34 and the two short support arms 46 can be integrally molded together as a single monolithic unit, such as a molded plastic, that forms the rail 32. The rail 32 can be formed of polypropylene, polycarbonate, or other resilient plastic material (e.g., an injection molded plastic), such as a thermoplastic polymer like Acrylonitrile butadiene styrene (ABS) plastic, for example. However, embodiments are not limited thereto and any suitable material can be used to form the rail 32.

Figure 4A:
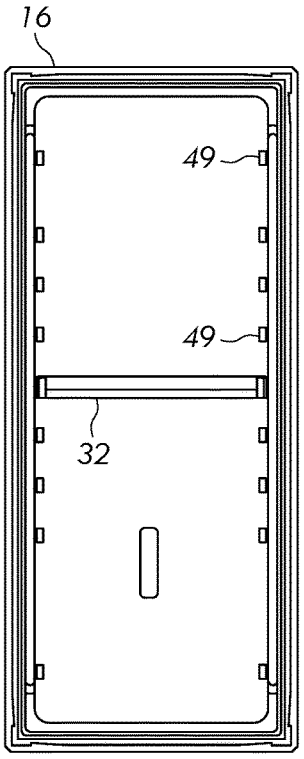
FIGS. 4*a*-4*c* illustrate the example rail shown in FIG. 3, which is mounted to a door of a refrigerator, according to an embodiment.
Figure 4B:
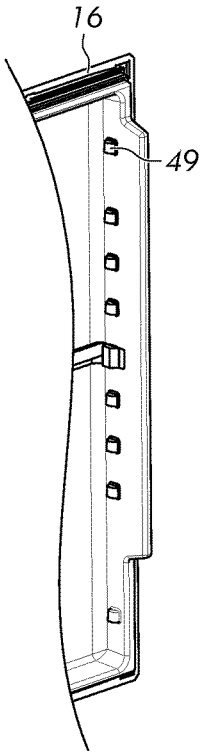
Figure 4C:
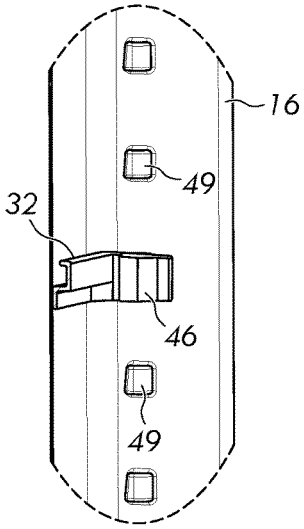

Turning to FIGS. 4*a*-4*c*, the refrigerator door 16 has a number of male projections 49, also referred to as mounting lugs, arranged along the vertical length of the door 16. Corresponding horizontally aligned pairs of the mounting structures 49 are spaced vertically along a height of an interior of the refrigerator door. The mounting structures 49 engage the rail 32 by connecting the corresponding female molded recess 47 on each of the two short support arms 46 to a corresponding male projection 49 formed on the interior of the refrigerator door 16. Preferably, each of said two support arms 46 are configured to attach to at least one of the corresponding horizontally aligned pairs of said plurality of mounting structures 49, and thereby securely support the rail 32 across the door in a horizontally level manner. The male projections 49 have shapes complementary to the shapes of the female molded recesses 47, such that the male projections 49 engage in a tight and stable locking manner, e.g., form a snap-fit connection, with the female molded recesses 47 to prevent shaking and rocking of the rail 32. Each of the male projections 49 extends outwardly from the surface of the inner liner 28 on one side of the door 16 in the lateral direction toward a corresponding male projection 49 on the other side of the door 16. Preferably, the two support arms 46 are resiliently attached to the main rail 34 so that they will "snap-fit" onto the male projections 49 formed within the refrigerator door 16. The user can select the exact height of the rail 32 by placing the rail between any two male projections 49 within the width of the door 16 at the preferred, selected height. Although described as the mounting structures 49 being male and the support arms having female recesses 47, it is contemplated that these could be reversed whereby the door liner includes the female recesses and the rail includes the male mounting structures. It could also be keyed whereby one end of the rail has a female recess and the other end of the rail has a male projection, with corresponding features on the door liner, so that the rail can only be installed in a single orientation upon the door.

Figure 5A:
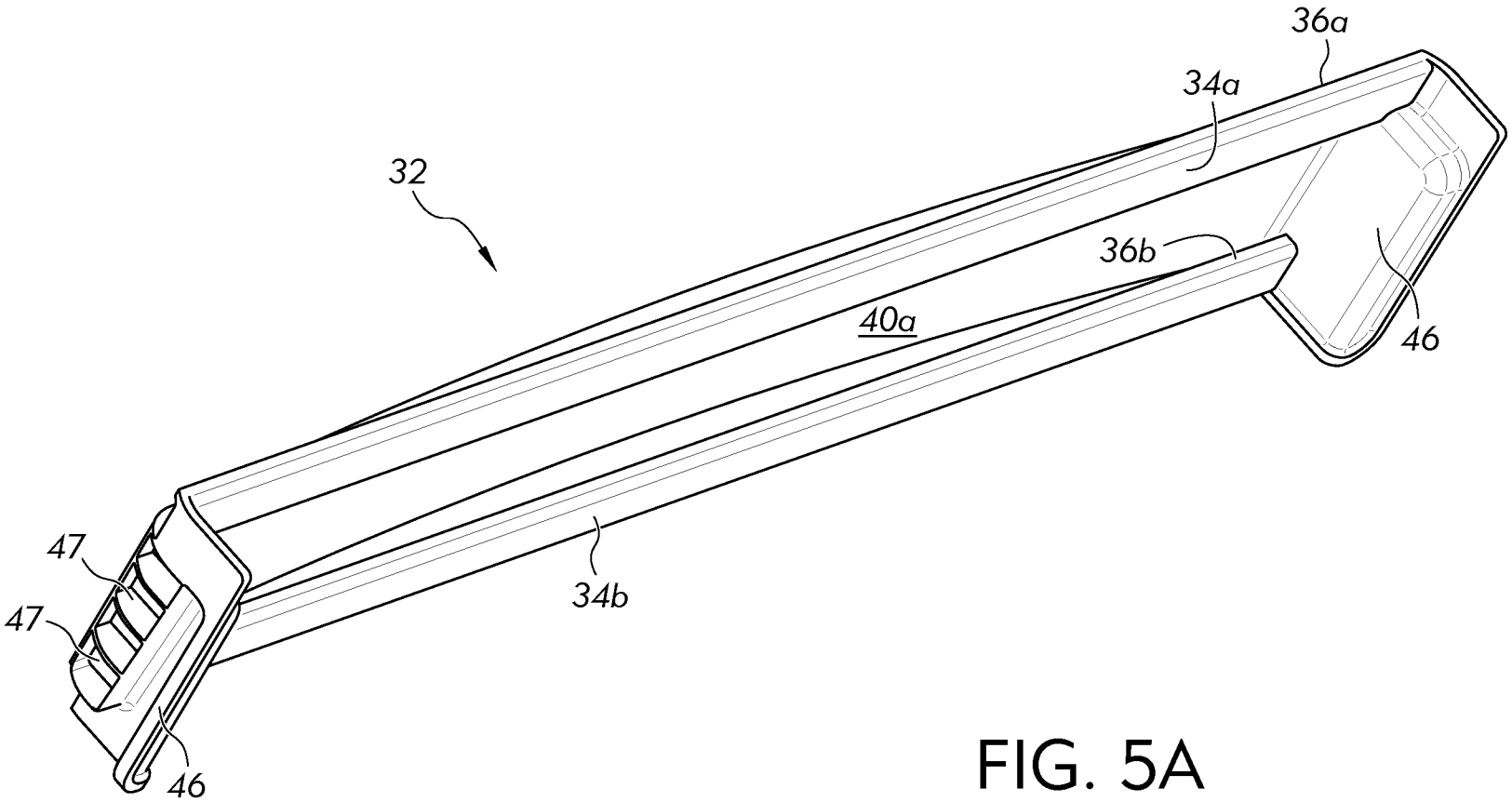
FIG. 5A illustrates a perspective view of a double rail, according to an embodiment
Figure 5B:
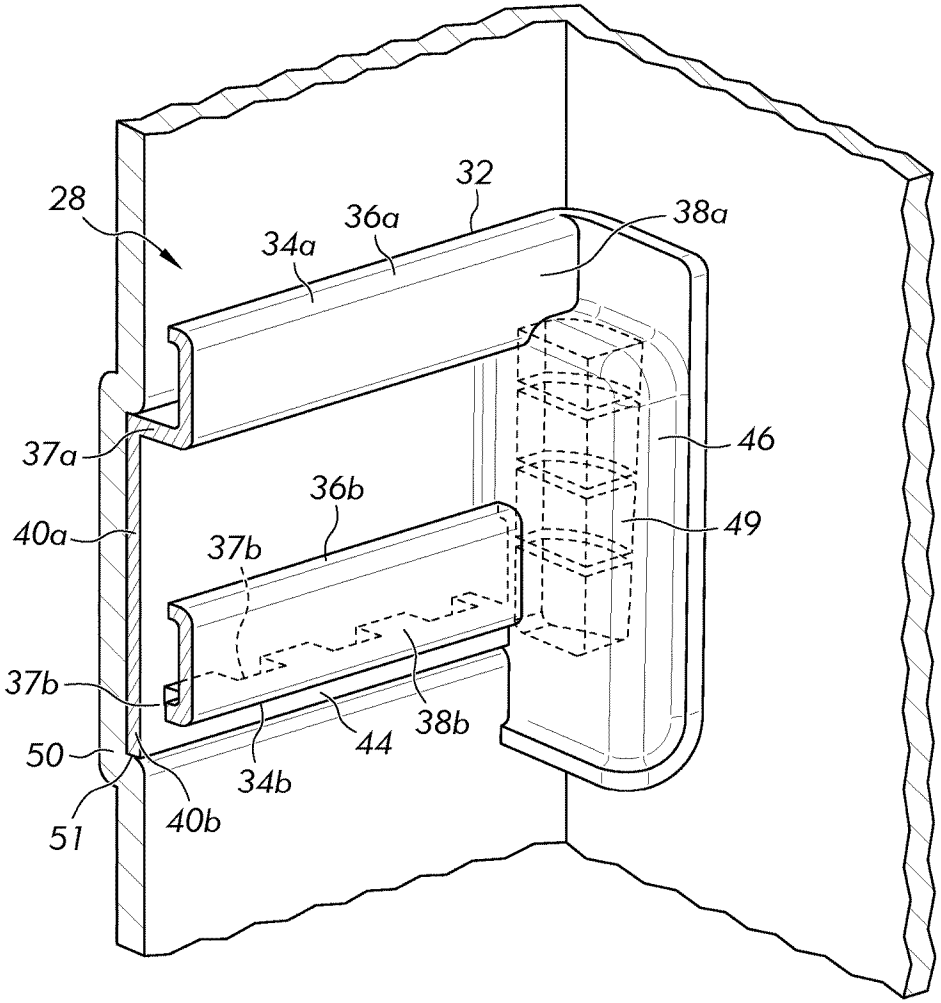
FIG. 5B illustrates a schematic view of the double rail mounted to a door of a refrigerator, according to an embodiment.

FIGS. 5A-5B show a perspective view and a cross-sectional view of a second embodiment of the rail 32 in another example of the subject invention. In this example, the rail 32 is again a "U"-shaped straight rail (as previously shown in FIG. 3). However, the rail 32 shown in FIGS. 5A-5B includes two elongated substantially horizontal main rails 34*a* and 34*b* separated vertically from each other and substantially parallel to each other in the vertical direction relative to the bottom of the refrigerator door 16. It is contemplated that the rail 32 could include a plurality of rails greater than the two shown, with the balance of the device being suitably enlarged to accommodate. Each of the horizontal main rails 34*a* and 34*b* can support various hanging baskets, containers, etc. The two elongated main rails 34*a* and 34*b* are integrally molded to each other and form a single monolithic unit that extends in the form of a single rail 32 along the width of the refrigerator door 16. Each horizontal main rail 34*a*, 34*b* includes a top horizontal surface 36*a*, 36*b*; a bottom horizontal surface 37*a*, 37*b*; a front-facing surface 38*a*, 38*b*; and a rear-facing surface 40*a*, 40*b*. Optionally, due to manufacturing processes with plastic molding, the bottom horizontal surface 37*b* of the lower rail 34*b* may be partially or completely eliminated (shown schematically in FIG. 5B). That is, the bottom horizontal surface 37*b* could either completely removed whereby the rail 34*b* is secured at each end to the support arms 46 (see FIG. 5A), or could partially extend (see FIG. 5B) with one or more holes therethrough, preferably periodically, to facilitate injection molding release. In yet another example, not shown, the bottom horizontal surface 37*b* could be continuous if one or more holes is provided in either or both of the rear-facing surfaces 40*a*, 40*b*. As shown, the rear-facing surface 40*a*, 40*b* can be defined by a common vertical wall extending between and connecting the two elongated main rails 34*a* and 34*b*. The bottom horizontal surfaces 37*a*, 37*b* have larger widths than the top horizontal surfaces 36*a*, 36*b* in order to provide a spacing gap to attach the bins 30 thereto, as will be described later herein. In other words, the bottom horizontal surfaces 37*a*, 37*b* extend all the way against and/or into the liner 28, while the top horizontal surfaces 36*a*, 36*b* extend to a lesser depth and leave a gap between the liner 28 and the rail 32, thereby providing space for a hook or other attachment structure of a bin (as described below). Of course, as noted above, the bottom horizontal surface 37*b* of the lower rail 34*b* may be partially or completely omitted.

As further shown in FIGS. 5A-5B, two short support arms 46 (similar to those shown in FIG. 3, but only one of the support arms 46 is shown in FIG. 5B) are provided on both sides of the rail 32, such that each of the two short support arms 46 interconnects the two main rails 34*a* and 34*b*. In other words, each rail 32 shown in FIGS. 5A-5B has two main rails 34*a* and 34*b*, and two short support arms 46 on each lateral side of the two main rails 34*a* and 34*b*.

In addition, similarly to the example shown in FIG. 3, each support arm 46 includes on its exterior surface at least one female molded recess 47 (examples shown schematically in broken lines in FIG. 5B) which is configured to interface and securely lock with at least one corresponding male projection 49 (shown with dotted lines in FIG. 5B and previously illustrated in FIGS. 4*a*-4*c*) formed on the interior of the refrigerator door 16.

Optionally, in the example illustrated in FIGS. 5A-5B, the support arms 46 can include two vertically positioned female molded recesses 47 (schematically shown in FIG. 5B), each of which is configured to interface and securely lock with two corresponding male projections 49. Such configuration with two main rails 34*a* and 34*b*, and two female molded recesses 47 interlocking with two corresponding male projections 49, provides additional support for the rail 32 and allows the user to attach heavier bins, without the danger of bending one of the main rails or unsnapping one of the female molded recesses 47 from its corresponding male projection 49, and completely detaching the rail 32 from the door 16. The rail 32 can be made of polypropylene, polycarbonate, or other resilient plastic material (e.g., an injection molded plastic), such as a thermoplastic polymer like Acrylonitrile butadiene styrene (ABS), for example. Optionally, the support arms 46 can include a single, vertically elongated female molded recess that can accept two projections 49.

The double-rail 32 shown in FIGS. 5A-5B allows the consumer to attach a large bin on one side of the rail 32 and provides the option of attaching a smaller (e.g., with a shorter height) bin on the other side of the rail 32, thereby allowing more efficient utilization of the storage space on the rail 32, as well as of the storage space on the door 16. In addition, because two separate main rails 34*a* and 34*b* are provided on the rail 32, the rail 32 also provides a solid support structure to securely retain multiple bins throughout the entire lateral length of the rail 32.

In one embodiment, the double-rail 32 shown in FIGS. 5A-5B can optionally be placed in a locking position within a complementary rectangular-shaped recess pocket 50 formed within and recessed a distance below the major surface of the refrigerator door liner panel 28. For example, the recessed pocket 50 of the liner panel 28 can include a bottom wall 51 which partially defines the recess pocket 50, which is open on one side to the compartment 18. The bottom portion 44 of the rail 32 can rest on the bottom wall 51 such that the bottom wall 51 provides support to the rail 32 and prevents movement of the rail 32, particularly when the rail 32 is loaded with bins or other storage structures. The recess pocket 50 may have a depth corresponding (e.g., equal) to the thickness of the rear wall of the rail 32 and a height corresponding (e.g., equal) to the height of the rail 32

(for example, to accommodate the common vertical wall that defines the rear-facing surface 40*a*, 40*b*). It is also to be appreciated that the rail 32 can be positioned such that only a small portion of the rail 32 (such as the attachment portion for the bin) may extend from the cavity 94 into the compartment 18. In this manner, the rail 32 will not needlessly occupy storage space within the compartment 18. In one embodiment, some or all of the leading edge of the bottom wall 51 of the recessed pocket 50 can define an upturned lip that captures and inhibits removal of the rail 32 from the pocket 50. The upturned lip can extend along the entire width of the bottom wall 51, or may only extend along portions thereof, and may even define a pattern of upturned lips. Optionally, the top wall of the recessed pocket 50 may likewise include a corresponding downturned lip (either a single or multiple lip(s)). During installation, the rail 32 can be snap-fit past the edge lip(s) into the recessed pocket 50 and retained therein by engagement with such lip(s). Alternatively, the rail 32 may be supported directly against the liner without the use of a pocket 50.

Figure 6:
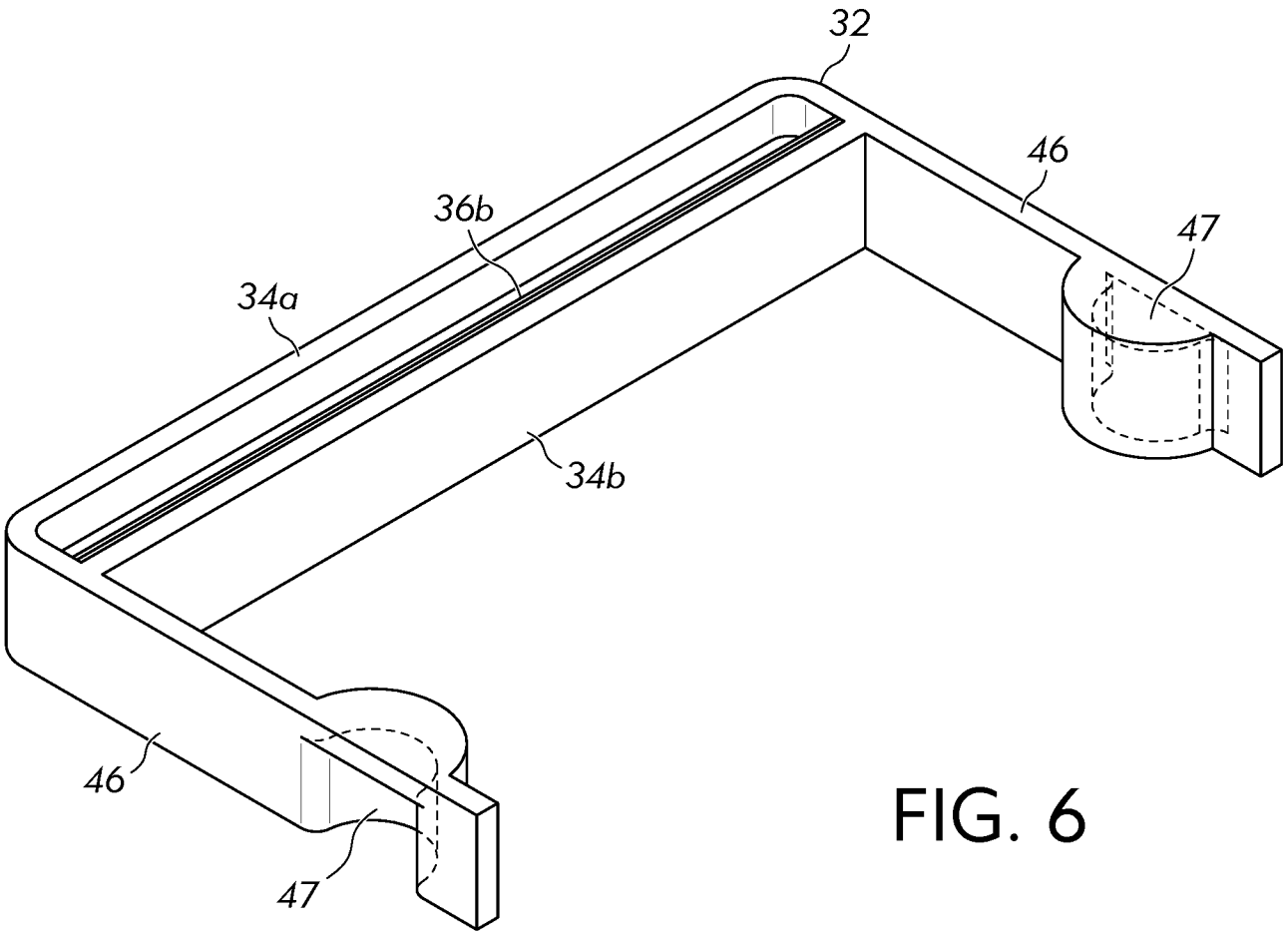
FIG. 6 is a schematic view of a double rail, according to another embodiment.

FIG. 6 shows another example of the rail 32, according to another embodiment of the subject invention. In this example, the rail 32 is again a "U"-shaped straight rail (as previously shown in FIG. 3 and FIGS. 5A-5B) with two elongated substantially horizontal main rails 34*a* and 34*b*, which are substantially parallel to each other. However, the two main rails 34*a* and 34*b* are now provided on the same vertical location and are substantially parallel to each other in the horizontal direction relative to the bottom of the refrigerator door 16. In other words, in this embodiment, one of the two main rails 34*a* is positioned behind the other main rail 34*b*. One main rail 34*a* (i.e., the outer rail) will be in abutment with the liner of the door, while the other main rail 34*b* (i.e., the inner rail) can support various hanging baskets, containers, etc. The top horizontal surface 36*b* of main rail 34*b* can curve and/or extend a distance towards the other main rail 34*a* thereby providing space and mating structure for a hook or other attachment structure of a bin (as described herein and generally similar to that of FIG. 5B). The two elongated main rails 34*a* and 34*b* are integrally molded to each other and form as a single monolithic unit that extends in the form of a single rail 32 along the width of the refrigerator door 16. As further shown in FIG. 6, two short support arms 46 are provided on both sides of the rail 32, such that each of the two short support arms 46 interconnects the two main rails 34*a* and 34*b*. That is, the rail 32 shown in FIG. 6 has two main rails 34*a* and 34*b*, and two short support arms 46 on each lateral side of the two main rails 34*a* and 34*b*.

In addition, similarly to the example shown in FIG. 3, each support arm 46 includes on its exterior surface at least one female molded recess 47, which is configured to interface and securely lock with at least one corresponding male projection 49 (illustrated in FIGS. 4*a*-4*c*) formed on the interior of the refrigerator door 16. In the example illustrated in FIG. 6, each of the support arms 46 include only one female molded recess 47, which is configured to interface and securely lock with one corresponding male projection 49. Optionally, the support arms 46 can include a single, vertically elongated female molded recess that can accept two projections 49, which can increase the weight loading capacity of the rail. The rail 32 can be made of polypropylene, polycarbonate, or other resilient plastic material (e.g., an injection molded plastic), such as a thermoplastic polymer like Acrylonitrile butadiene styrene (ABS), for example.

In one embodiment, the double-rail 32 shown in FIG. 6 can be placed in a locking position within a complementary rectangular-shaped recess pocket formed within the refrigerator door liner panel, similarly to the embodiment shown in FIG. 5B.

Figure 7:
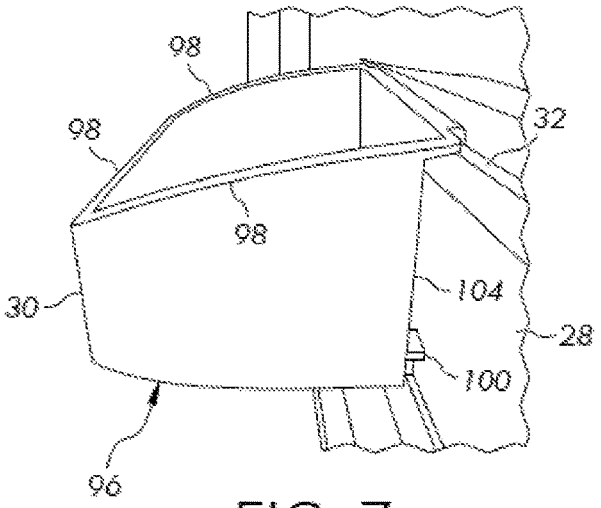
FIG. 7 is a perspective view of a bin in a storage position engaged with the rail and liner panel.

FIG. 7 is a side view of a bin 30, which is part of the storage system 14. The bin 30 can be used for storing food items in a temperature-controlled environment, such as the refrigerator compartment 18. The bin 30 can include a substantially-horizontal platform 96 used as a support surface for supporting various objects, such as items that will be stored in the bin 30. The platform 96 can be made of plastic, glass, wire, or any other suitable rigid material. For example, the platform 96 can be a substantially continuous flat support surface. The platform 96 can be coupled to a plurality of upwardly-extending walls 98 to form an open container configured to receive various objects such as food items.

The plurality of walls 98 can upwardly extend from the perimeter of the platform 96 to form a partially enclosed volume. In one example, four walls 98 can extend from the platform 96, and the walls 98 can include various curves, undulations, etc. to correspond to any number of perimeter shapes of the platform 96. In another example, the wall 98 facing a user on the exterior of the refrigerator can be shorter than the remaining walls in order to improve access to the space within the bin 30 and limit necessary lifting required to insert and/or remove objects to and from the bin 30. In a more particular example, the bin 30 may not have a wall facing the user.

The bin 30 can also include at least one foot 100 extending from a rear surface 104 of the bin 30. The foot 100 contacts the liner panel 28 when the bin 30 is placed into a storage position as shown in FIG. 7. The foot (feet) 100 can help maintain the platform 96 in a substantially horizontal position. In one example, the foot 100 can also provide friction between the foot 100 and the liner panel 28 to help limit side to side movement of the bin 30 as will be described below. It is to be appreciated that the foot 100, walls 98, and the platform 96 can be made of essentially the same material, for example, plastic, glass, wire, or any other suitable rigid material such as a polystyrene composition. In another example, the foot 100 and walls 98 can be molded together with the platform 96 such that the platform 96, the walls 98, and the foot 100 are constructed of one unitary piece.

Figure 8:
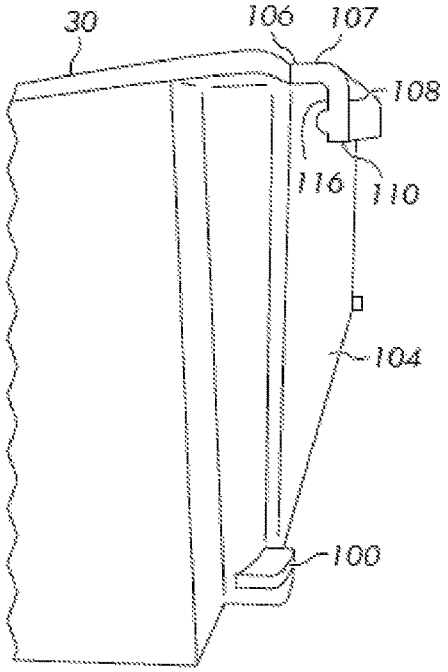
FIG. 8 is a side view of the bin of FIG. 7 showing an arm and a foot.

The attachment of the storage bin 30 to the rail 32 may be achieved using any type of mounting member having a shape that would correspond to the shape of the rail 32. For example, as illustrated in FIG. 8, the bin 30 can include an arm 106 extending from a rear surface 104 of the bin 30. The arm 106 can be of any suitable shape or orientation including planar configurations, arcuate configurations such as a hook, etc. In the shown example of FIG. 8, the arm 106 can include a substantially horizontal first arm portion 107 extending from a rear surface 104 of the bin 30. While the first arm portion 107 is shown extending from the rear surface 104 at the upper most portion of the rear surface 104, the first arm portion 107 can be placed at any suitable location. The arm 106 can also include a substantially vertical second arm portion 108 extending downward from the first arm portion 107. The second arm portion 108 is configured to be placed between the rail 32 and the liner panel 28 (best seen in FIG. 9) when the bin 30 is placed in a storage position as shown in FIG. 6. The second arm portion 108 can further include a substantially horizontal second protrusion 110 on a front-facing surface 116 of the second arm portion 108.

Figure 9:
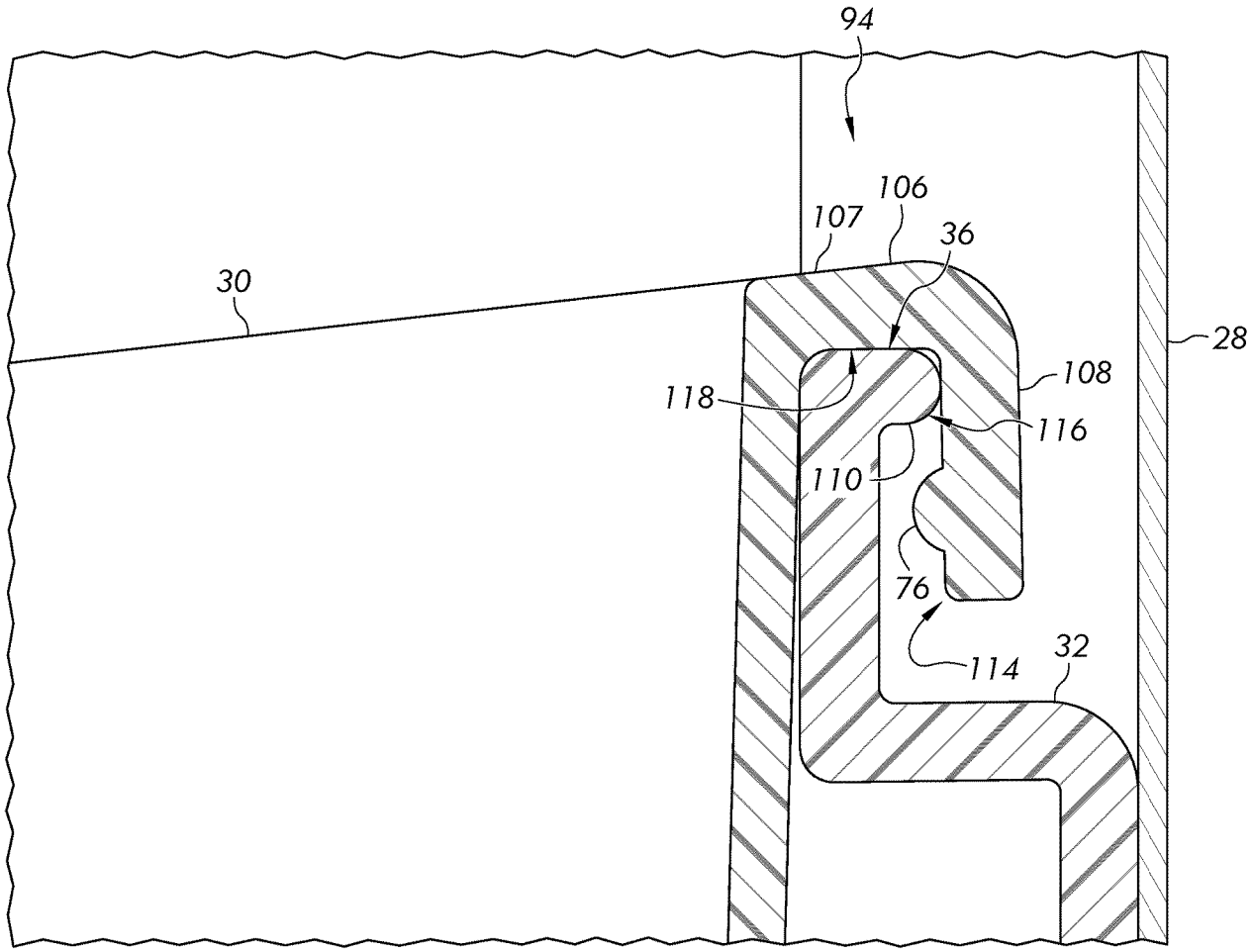
FIG. 9 is a side view of the bin of FIG. 8 showing detail of the arm.

FIG. 9 shows a cross-section detail of a structure included on the bin 30 interacting with the structure of the rail 32. The bin 30 is shown in a storage position including the second arm portion 108 placed between the rail 32 and the liner panel 28. In one example, the first protrusion 76 and the second protrusion 110 are configured to interact with each other. As shown in FIG. 9, a distal end of the second protrusion 110 is relatively close to and/or contacts the front-facing surface 116 of the second arm portion 108. This proximity between the first protrusion 76 and the second protrusion 110 create a physical interference when the bin 30 is placed in or removed from the storage position shown in FIG. 9.

This physical interference helps prevent unintentional removal of the bin 30 from engagement with the rail 32. This physical interference can be overcome by application of a relatively small amount of force placed upon the bin 30. When the bin 30 is in the storage position, an adequate amount of force in the upward direction will elastically deform one or both of the first arm portion 107 and the second arm portion 108 such that the first protrusion 76 and the second protrusion 110 pass each other. This enables the bin 30 to be removed from engagement with the rail 32, after which the first arm portion 107 and the second arm portion 108 return to their original shape/position. Similarly, engagement of the bin 30 with the rail 32 require an adequate amount of downward force to elastically deform one or both of the first arm portion 107 and the second arm portion 108 such that the first protrusion 76 and the second protrusion 110 pass each other. After the first protrusion 76 and the second protrusion 110 pass each other, the first arm portion 107 and the second arm portion 108 return to their original shape/position and the second arm portion 108 is located between the rail 32 and the liner panel 28. As such, the bin 30 is placed in the storage position.

Additionally, the bottom surface 118 of the first arm portion 107 contacts the top surface 36 of the rail 32. This contact interaction provides friction force that can overcome a tendency of the bin 30 to slide from side-to-side when the door 16 is opened and closed. In one example, the materials of the first arm portion 107 of the bin 30 and the top surface 36 of the rail 32 can be selected to give rise to a particular desired coefficient of static friction between the bin 30 and the rail 32. As previously discussed, the bin 30 can be constructed of the polystyrene and the rail 32 can be constructed of ABS plastic. As shown in FIG. 9, contact can optionally be maintained between the bin 30 and the rail 32 in other locations as well. As shown in FIG. 7, the feet 100 can also contribute to the friction force between the bin 30 and the rail 32.

Figure 10:
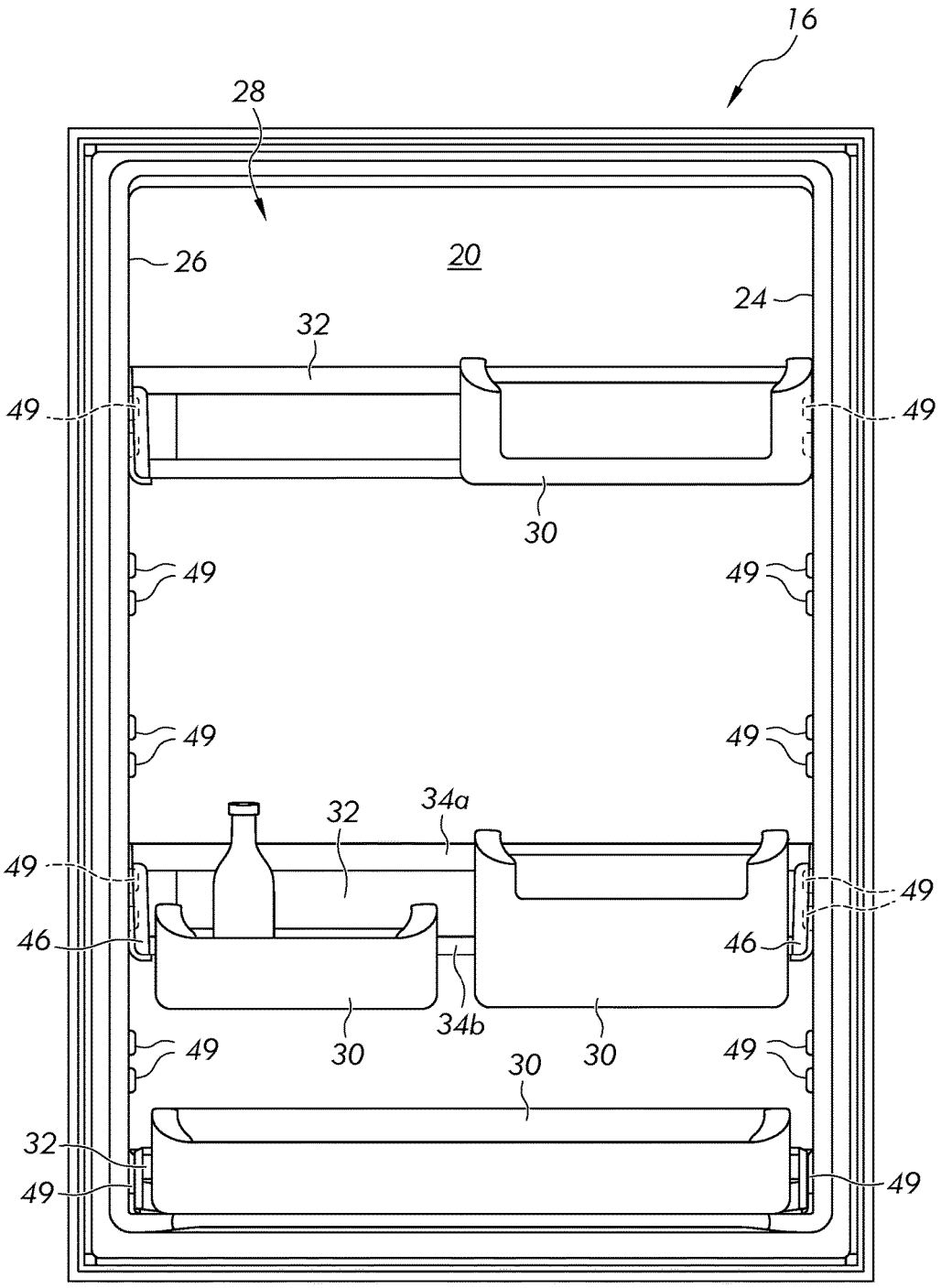
FIG. 10 is a view of the door of FIG. 1 including one example arrangement of storage rails and bins.

Turning to FIG. 10, an interior view the door 16 is shown with a plurality of bins 30 engaged with a plurality of rails 32. As shown, the bins 30 can include a width that is less than the full width of the rail 32. As such, each bin 30 may be selectively moved from side-to-side along the rail 32. The lower-most bin 30 in this example extends across substantially the entire available width between the right wall 24 and the left wall 26, though it is appreciated that the width of the bin 30 can be varied in any of the example bins 30 as shown in the upper bins 30. The middle example bins 30 illustrate a regular bin on the right-hand side that is supported by the upper rail 34*a*, and a short-height bin on the left-hand side that is supported by the lower rail 34*b*. The use of a short-height bin permits the storage of extra tall items in the same location upon the door without contacting an upper bin, such as tall beverage bottles or the like. It is further contemplated that other refrigerator structures (i.e., shelves, baskets, water dispenser, ice dispenser, etc.) can be mounted directly upon the door via the mounting projections 49 without using the rails 32. In this manner, the door may contain various bins 30 mounted on the rails 32 described herein, in combination with other directly mounted refrigerator structure to increase the storage flexibility of the door.

Turning back to FIG. 9, when the user chooses to move one or more bins 30 from side-to-side on the rail 32, the friction between the rail 32 and the bin 30 must be overcome. In such a situation, the user can apply an upward force to the bin 30 of lesser magnitude than the previously described force required to remove the bin 30 from the storage position. This force lifts the bottom surface 118 of the first arm 107 a relatively short distance away from the top surface 36 of the rail 32 to reduce the friction force between the bin 30 and the rail 32. In this position, the first protrusion 76 and the second protrusion 110 have not passed each other, and contact between the two can supply a tactile indication to the user that the bin 30 is lifted away from the rail 32 to a satisfactory distance for side-to-side motion. Then, the user applies an additional force in a lateral direction to move the bin 30 sideways. Once the bin 30 is in a desired location, the user can remove both forces, at which time, the bottom surface 118 of the first arm 107 contacts the top surface 36 of the rail 32, and the bin is returned to a storage position. It is to be appreciated that the bins 30 can be positioned along a plurality of locations, and the bin 30 position is not limited by discrete locations such as individual bin or shelf mounts located on the door 16 or the liner panel 28.

The described storage system and refrigeration appliance include several advantages. The above described liner panel provides the user with flexibility to arrange storage components within the refrigerator by using double or single rails configured to accommodate bins with different dimensions and weights, depending on the user's current needs and preferences. At the same time, the described storage system does not require additional mechanical fasteners to attach the rail to the liner panel, as it allows for an easy "snap-fit" assembly of the necessary rails. Another advantage of the described storage system is an improved resistance to rail break-away or separation of the rails from the liner panel under heavy load conditions.

Any combination of attaching, removing, or reattaching of the components of the storage bin assembly system is contemplated herein. For example, a consumer may wish to remove some or all storage components from the door or the compartment to, for example, clean the storage compartment and/or the interior of the refrigerator. In another example, the consumer may wish to organize the storage compartments in an arrangement that would accommodate an item of large or odd size. It is to be understood that the interchangeability of the storage components with the storage bin assembly system provides consumers flexibility when arranging and organizing the contents of their refrigerator. Further, one or more storage bins may be attached to the storage bin assembly system. The storage bins may be substantially similar, such as identical, or may be of varying shapes and sizes to accommodate different items to be stored in the storage components.

Many other example embodiments can be provided through various combinations of the above described features. Although the embodiments described hereinabove use specific examples and alternatives, it will be understood by those skilled in the art that various additional alternatives may be used and equivalents may be substituted for elements and/or steps described herein, without necessarily deviating from the intended scope of the application. Modifications may be desirable to adapt the embodiments to a particular situation or to particular needs without departing from the intended scope of the application. It is intended that the application not be limited to the particular example implementations and example embodiments described herein, but that the claims be given their broadest reasonable interpretation to cover all novel and non-obvious embodiments, literal or equivalent, disclosed or not, covered thereby.

What is claimed is:

1. A refrigerator door storage bin assembly system comprising:

a refrigerator door comprising a liner panel with an opposed pair of side walls;

a plurality of mounting structures formed within the liner panel to extend outwardly from each of the pair of side walls, and corresponding horizontally aligned pairs of the plurality of mounting structures spaced vertically along a height of an interior of the refrigerator door;

a plurality of rails, each rail including at least one elongated main portion extending in a generally horizontal direction across substantially an entire width of the refrigerator door and two support arms, each of the two support arms being provided on one of each side of the at least one elongated main portion, each of said two support arms being configured to attach to at least one of the corresponding horizontally aligned pairs of said plurality of mounting structures; and a plurality of detachable storage bins, each storage bin comprising:

a container, and at least one fastener located in a rear top portion of the storage bin, said at least one fastener being configured to attach the storage bin to the at least one elongated main portion of at least one rail of said plurality of rails and allow said storage bin to slide laterally in a plurality of positions along a width of the at least one rail of said plurality of rails, wherein at least one rail of said plurality of rails comprises at least two of the elongated main portions, each of the at least two elongated main portions extending in the generally horizontal direction across substantially the entire width of the refrigerator door, and the two support arms, the two support arms being provided on each side of the at least two elongated main portions, and each of said two support arms being configured to attach to at least one of the plurality of mounting structures, wherein the at least two elongated main portions are separated from, and parallel to, each other in the generally horizontal direction relative to a bottom of the refrigerator door, and wherein the at least two elongated main portions have a same height relative to the bottom of the refrigerator door, said same height being limited by a top elongated main portion and a bottom elongated main portion, and the top elongated main portion and the bottom elongated main portion are both provided on a same vertical location relative to the bottom of the refrigerator door.

2. The refrigerator door storage bin assembly system according to claim 1, wherein each of the plurality of mounting structures is formed as a projection extending outwardly and laterally from a surface of the liner panel.

3. The refrigerator door storage bin assembly system according to claim 1, wherein at least one of the plurality of detachable storage bins has a width that is less than a full width of at least one of the plurality of rails, such that the at least one of the plurality of detachable storage bins may be selectively moved from side to side along the at least one of the plurality of rails.

4. The refrigerator door storage bin assembly system according to claim 1, wherein the at least one fastener of at least one of the plurality of detachable storage bins comprises an arm extending from a rear surface of the bin, wherein at least a portion of the arm is placed between the at least two elongated main portions of the rail when the bin is placed in a storage position.

5. The refrigerator door storage bin assembly system according to claim 1, wherein at least one of the plurality of mounting structures comprises at least one projection extending from a surface of the liner panel.

6. The refrigerator door storage bin assembly system according to claim 1, wherein the at least one fastener of one of the plurality of detachable storage bins includes an arm extending from a rear surface of the bin, wherein at least a portion of the arm is placed between the at least two of the elongated main portions of the rail when the bin is placed in a storage position.

7. The refrigerator door storage bin assembly system according to claim 6, wherein the bin includes at least one foot extending from the rear surface of the bin which contacts the liner panel when the bin is placed into the storage position.

8. The refrigerator door storage bin assembly system according to claim 1, wherein at least one of the plurality of rails is configured to be mounted within a recess pocket formed in the liner panel of the refrigerator door.

9. The refrigerator door storage bin assembly system according to claim 1, further comprising at least one first rail of said plurality of rails with one elongated main portion and at least one second rail of said plurality of rails with at least two elongated main portions.

10. The refrigerator door storage bin assembly system according to claim 1, wherein the at least two elongated main portions have an equal length across the width of the refrigerator door.

11. A refrigeration appliance comprising:

at least one compartment for storing items in a refrigerated environment;

a refrigeration system for providing a cooling effect within the compartment;

at least one door attached to the refrigeration appliance and providing access to the at least one compartment, wherein the door comprises a liner panel with an opposed pair of side walls and a door storage bin assembly system, wherein the door storage bin assembly system comprises:

a plurality of mounting structures formed with the liner panel to extend outwardly from each of the pair of side walls and corresponding horizontally aligned pairs of the plurality of mounting structures spaced vertically along a height of an interior of the door;

a plurality of rails, each rail including at least one elongated main portion extending in a generally horizontal direction across substantially an entire width of the door and two support arms, each of the two support arms being provided on one of each side of the at least one elongated main portion, each of said two support arms being configured to attach to at least one of the corresponding horizontally aligned pairs of said plurality of mounting structures; and a plurality of detachable storage bins, each said storage bin comprising:

a container, and at least one fastener located in a rear top portion of the storage bin, said at least one fastener being configured to attach the storage bin to the at least one elongated main portion of at least one rail of said plurality of rails and allow said storage bin to slide laterally in a plurality of positions along a width of the at least one rail of said plurality of rails, wherein at least one rail of said plurality of rails comprises at least two of the elongated main portions, each of the at least two elongated main portions extending in the generally horizontal direction across substantially the entire width of the refrigerator door, and the two support arms, the two support arms being provided on each side of the at least two elongated main portions, and each of said two support arms being configured to attach to at least one of the plurality of mounting structures, wherein the at least two elongated main portions are separated from, and parallel to, each other in the generally horizontal direction relative to a bottom of the door, and wherein the at least two elongated main portions have a same height relative to the bottom of the refrigerator door, said same height being limited by a top elongated main portion and a bottom elongated main portion, and the top elongated main portion and the bottom elongated main portion are both provided on a same vertical location relative to the bottom of the refrigerator door.

12. The refrigeration appliance according to claim 11, wherein each of the plurality of mounting structures is formed as a projection extending outwardly and laterally from a surface of the liner panel.

13. The refrigeration appliance according to claim 11, wherein at least one of the plurality of detachable storage bins has a width that is less than a full width of at least one of the plurality of rails, such that the at least one of the plurality of detachable storage bins may be selectively moved from side to side along the at least one of the plurality of rails.

14. The refrigeration appliance according to claim 11, wherein the at least two elongated main portions have an equal length across the width of the door.

* * * * *